United States Patent [19]

Burke

[11] 4,313,569

[45] Feb. 2, 1982

[54] FLUID DISPENSER METHOD AND APPARATUS

[75] Inventor: James E. Burke, Huntington, Conn.

[73] Assignee: Ethyl Products Company, Richmond, Va.

[21] Appl. No.: 153,772

[22] Filed: May 27, 1980

[51] Int. Cl.[3] ..... B65D 47/34

[52] U.S. Cl. ..... 239/333; 222/380; 222/496; 239/493; 239/533.1

[58] Field of Search ..... 239/333, 452, 453, 456, 239/458, 459, 464, 492, 493–495, 497, 533.1, 533.13–533.15, 570; 222/380, 385, 494, 496, 520

[56] References Cited

U.S. PATENT DOCUMENTS

| | | | |
|---|---|---|---|
| 3,437,270 | 4/1962 | Venus, Jr. | 239/533.13 X |
| 3,685,739 | 8/1972 | Vanier | 239/333 |
| 3,840,157 | 10/1974 | Hellenkamp | 222/385 X |
| 3,843,030 | 10/1974 | Micallef | 239/478 X |
| 3,967,765 | 7/1976 | Micallef | 239/478 X |
| 4,161,288 | 7/1979 | McKinney | 239/333 |
| 4,249,681 | 2/1981 | French | 239/452 X |

*Primary Examiner*—Andres Kashnikow

*Attorney, Agent, or Firm*—Donald L. Johnson; John F. Sieberth; Edgar E. Spielman, Jr.

[57] ABSTRACT

A three-piece nozzle is disclosed, for fitment to a hand actuated liquid pump having a barrel portion with a bore therethrough for passage of liquid. The nozzle features an integrally formed nozzle cap which fits around the end portion of the barrel. Enclosed within the nozzle cap is an integrally formed nozzle seal which forms a peripheral liquid-tight seal around the barrel between the nozzle cap and the barrel. Also provided is an integrally formed check valve which is movably positioned at the mouth of the bore and which is biased towards the mouth of the bore to form a liquid-tight bore seal. The bias is overcome, to open the liquid-tight bore seal, upon actuation of the pump which provides liquid pressure in the bore to act against the check valve.

24 Claims, 10 Drawing Figures

FLUID DISPENSER METHOD AND APPARATUS

BACKGROUND OF THE INVENTION

Aerosol dispensers, which are widely used in the packaging industry, present two major problems, atmospheric pollution from the propellant and disposal of the cannister without the risk of explosion and the accompanying hazard to personal safety. The use of hand actuated pump dispensers as a substitute for aerosol dispensers obviates these problems.

Typical pump dispensers presently on the market incorporate a manually operable reciprocating pump mechanism as part of a screw-on closure for a container so that the dispenser may be removed from the container for refilling the container. Such dispensers may have a trigger member, plunger or other protruding element which is intended to be moved manually to operate a pump piston in the dispenser, usually against the force of a return spring, so that liquid may be pumped from the container and dispensed through the liquid ejection nozzle or outlet of the device.

To meet consumer demands for convenience it has been found highly desirable that the nozzle be adjustable to provide widely varying discharge patterns, i.e. a spray pattern and a stream pattern. Exemplary of such nozzles are the ones described in U.S. Pat. Nos. 3,843,030, 3,967,765 and 3,685,739. Since it is also highly desirable that the dispensers should have the ability to be attached to the container for shipment, it is mandatory that the dispenser be capable of acting as a liquid-tight closure for the container during shipment. This liquid-tight characteristic should be present even if the container is tipped over on its side and remains in such position for a long period of time. To achieve this characteristic the dispensers disclosed in the above-mentioned patents all have an "Off" position which is designed to close off the nozzle opening to prevent leakage therethrough. However, the consumer is not always that observant and will, on many occasions, leave the nozzle in the "Spray" or "Stream" position which will result in the nozzle being open to leakage should the container be tipped over. Also, it is possible that leakage could occur should the nozzle be inadvertently positioned in a position which places the containers upside down or on their sides.

The answer to this problem is to provide the dispenser with a static seal which is not dependent upon whether or not the dispenser nozzle is in an open or closed position. A highly useful dispenser design which provides such structure is described in U.S. Pat. No. 4,161,288. This structure is capable of providing multiple dispensing patterns and is capable of maintaining a liquid-tight seal at the nozzle irrespective of whether or not the nozzle is adjusted to the open or closed position. This design, however, is not without certain drawbacks. Referring to the disclosure in this patent, it is seen that a flexible nozzle check valve is provided which fits onto the nozzle barrel and closes the pump bore off. Due to the valve design and the fact that the valve is of an elastomeric material, e.g. thermoplastic rubber, the pump bore is sealed off when there is no fluid pressure applied against the nozzle check valve through the pump bore. In this mode the situation is static and no leakage is possible through the bore even should the container be tipped over. To dispense the product the liquid-tight seal made by the nozzle check valve is broken by the force of the fluid being pumped through the bore and against the valve. Since the valve is made of elastomeric material, it is able to expand out in response to such force and allow the fluid to be dispensed. When the fluid pressure is relieved, such as at the end of the pumping stroke, the nozzle check valve can return to its seated position sealing off the pump bore. But because of the necessity to use an elastomeric material for the valve, difficulty is encountered when the product to be dispensed is such that it interacts with the elastomeric material and causes the nozzle valve to lose its elastic quality or to swell. Exemplary of products which have been found to have adverse reactions with elastomeric materials are petroleum distillates, hydrocarbon solvents, etc. Thus even though the dispenser shown in U.S. Pat. No. 4,161,288 has many advantages and is capable of providing a multipattern dispensing mode and is able to achieve static sealing of the pump bore, it is still incapable of handling materials which react adversely with the nozzle check valve.

Therefore, it is an object of the present invention to provide a nozzle system which is usable on manually operated reciprocating dispensing pumps, which has multiple dispensing modes, which is capable of achieving a static seal over the pump bore, and which is capable of handling products not manageable by present-day elastomeric materials.

THE INVENTION

This invention relates to a nozzle fittable to hand actuated liquid pumps having a barrel portion with a bore therethrough for the passage of liquid. Exemplary of such pumps are the ones disclosed in U.S. Pat. Nos. 3,685,739, 3,840,157 and 4,161,288. The nozzle of this invention is usable on other pump configurations, the only requirement being that the liquid pumped through the bore must be pumped at a pressure sufficient to operate the check valve and achieve the desired dispensing pattern, e.g. spray, stream, etc.

The nozzle of this invention has, as one of its parts, an integrally formed nozzle cap. The cap mounts to the end of the pump barrel and has an end wall with an aperture therethrough for passage of the liquid from the bore as it is dispensed. Enclosed by the nozzle cap is an integrally formed nozzle seal which is attached to the end of the barrel. The seal provides a peripheral liquid-tight seal around the barrel between the nozzle cap and the barrel. The nozzle seal also has a flange which, when the seal is attached to the barrel, is displaced outwardly from the end of the barrel.

A check valve, which is integrally formed, is movably positioned at the mouth of the bore. The check valve has a seal portion which selectively forms a liquid-tight bore seal at the end of the barrel to close off the flow of liquid through the bore. The check valve also has a spring portion which is in contact with the flange whereby the spring portion biases the seal portion to form its liquid-tight bore seal. While the spring has sufficient strength to achieve this liquid-tight bore seal it does not have sufficient strength to maintain this seal against liquid pressure which builds in the bore as the pump is actuated. Upon actuation of the pump, therefore, the liquid-tight bore seal is opened thereby allowing liquid to pass through the bore to the aperture in the end wall of the nozzle cap.

The components of the nozzle of this invention, due to their unique configuration and to their relationship with one another, can be made of a thermoplastic such as polyethylene or polypropylene. The use of an elastomeric material is not necessary with this pump. Polyethylene and polypropylene have a high resistance to damage or swelling by various hydrocarbons and/or solvents and thus the nozzle of this invention can maintain fidelity of operation even when these materials are dispensed by the pump.

It is also possible with the nozzle of this invention to provide a nozzle having a shut-off mode, a first dispensing mode and a second dispensing mode. The shut-off mode is effected by moving the nozzle cap so that the inside surface of the end wall presses against the check valve to prevent its movement from the end of the bore. The first dispensing mode, which can be a spray mode, is achieved by providing the nozzle end wall with a planar inside surface at the aperture and by providing the check valve with a planar face which is abutable with the planar inside surface at the aperture. The planar face will have liquid passage channels for providing a spray pattern when the planar face is abuted against the planar inside surface and liquid passes through the channels. The configuration of these channels can be any of the conventional "swirl chamber" configurations which are well known to those skilled in the art for achieving break-up of the liquid stream to provide the spray dispensing mode. To provide abutment of the planar face against the planar inside surface of the nozzle cap while at the same time allowing opening movement of the check valve it is necessary that the nozzle cap be moved away from the bore. The distance moved, however, cannot be so far that the planar face is unable to reach an abutting position upon the urging of liquid pressure against the check valve. Upon actuation of the pump the check valve will be urged forward of the bore until the planar face achieves abutment with the planar inside surface of the nozzle cap. When the pressure is relieved at the end of the dispensing stroke the check valve moves back to achieve the liquid-tight seal and the planar face moves out of abutment with the planar inside surface of the nozzle cap.

In the second dispensing mode, e.g. a stream mode, the nozzle cap is moved further yet from the end of the bore so that the planar face cannot reach the planar inside surface and thus not achieve the necessary abutment. When this occurs the liquid is free to pass through the aperture without going through the liquid passage channels in the planar face which passage would normally result in a spray pattern.

The structure for mounting the nozzle cap to the pump barrel is preferably a helical thread on the nozzle cap which is in cooperation with a helical thread carried by the barrel. By utilizing helical threads it is thus easy to position the nozzle cap at any selected distance from the check valve and the pump bore.

These and other features of this invention contributing satisfaction in use and economy in manufacture will be more fully understood from the following description of a preferred embodiment and the accompanying drawings in which identical numerals refer to identical parts and in which.

Figure 1:
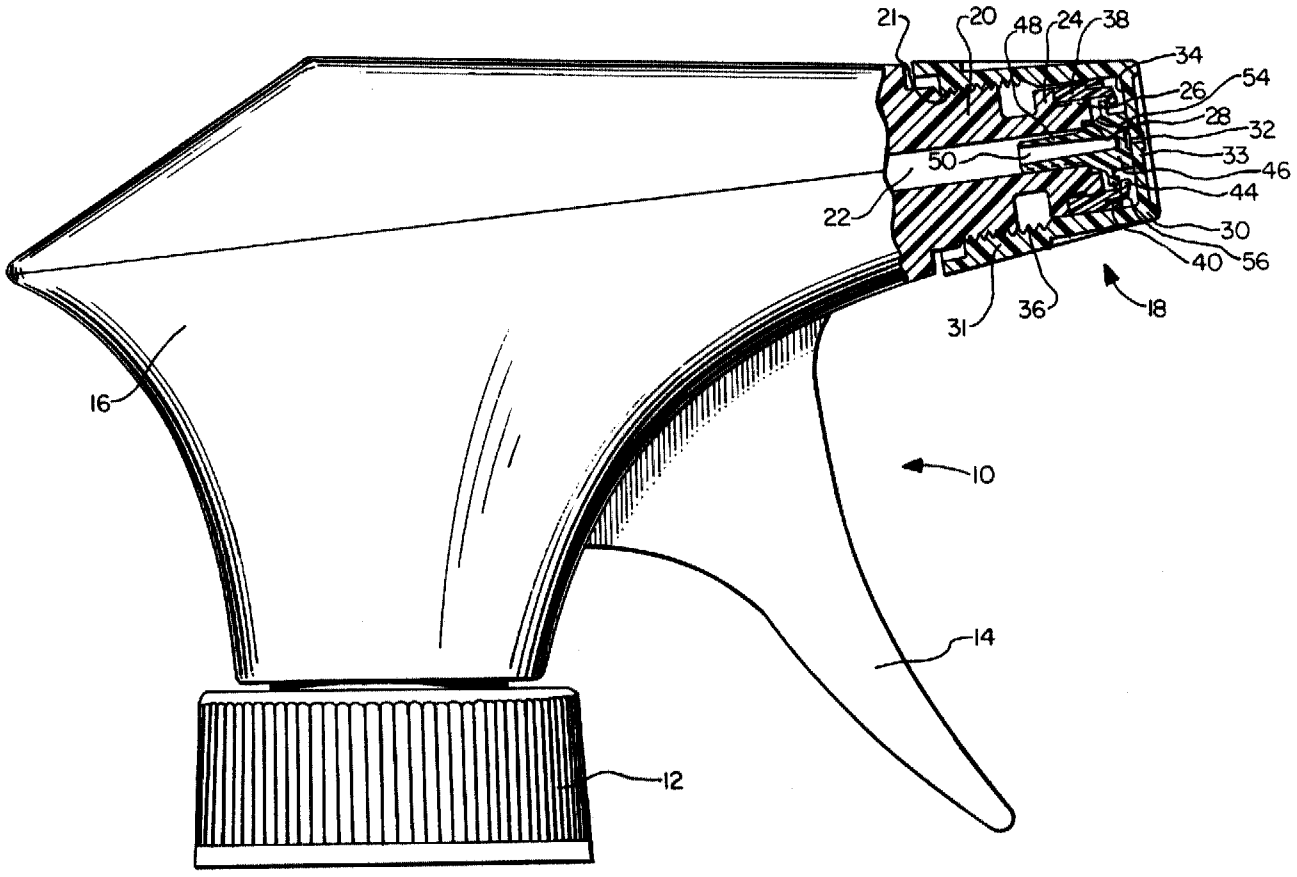
FIG. 1 is a partially broken away side elevational view of a nozzle of this invention.

In FIGS. 1–10 there can be seen a nozzle of this invention, generally designated by the numeral 18. The nozzle is affixed to a hand-actuated pump, generally designated by the numeral 10. Pump 10 is affixed to a container by means of pump closure cap 12. Closure cap 12 forms a liquid-tight seal with the container so that the contents of the container cannot leak out should the container be tipped over. Pump housing 16 encloses the pumping mechanism for pumping the liquid from the container upon actuation of pump trigger 14. The particular design of the pump mechanism is not critical to the operation of the nozzle of this invention as long as sufficient liquid pressure is provided upon actuation of the pump to operate the nozzle parts as hereinafter described.

Nozzle 18 is affixed to the barrel of the pump, indicated by the numeral 20. Barrel 20 has helical thread 21 which cooperates with nozzle cap thread 36 for affixing nozzle 18 to the pump. Nozzle 18 has three component parts, a nozzle cap 30, a nozzle seal 38, and a check valve 46. Nozzle cap 30 has a nozzle cap end wall 33 with a dispensing aperture 32 therethrough. There is provided a planar inside surface 34 on the inside of nozzle cap end wall 33. Inside surface 34 surrounds dispensing aperture 32. Integrally formed with nozzle cap end wall 33 is nozzle cap skirt 31. This skirt carries the afore-described nozzle cap thread 36.

Nozzle cap 30 encloses nozzle seal 38. Nozzle seal 38 is mounted to the end of barrel 20 by means of a friction fit over collar 26 which is located at the end of barrel 20. Achieving the precise location of nozzle seal 38 with respect to the end of barrel 20 is accomplished by means of annular collar 24 which is an integral part of barrel 20. This collar acts as a stop structure for positioning the nozzle seal 38. Nozzle seal 38 is integrally formed and has as a part thereof sealing lip 40. Sealing lip 40 is dimensioned to achieve a peripheral liquid-tight engagement with nozzle cap 30 as is seen in FIGS. 1–4. Sealing lip 40, therefore, prevents leakage between barrel 20 and nozzle cap 30. Other sealing arrangements, of course, may be utilized, the one utilized by the embodiment shown in the drawings being a preferred configuration. Nozzle seal 38 also has an inwardly directed stop flange 44 which functions as a non-moving structure against which the spring utilized on check valve 46, as hereinafter described, can abut.

Figure 7:
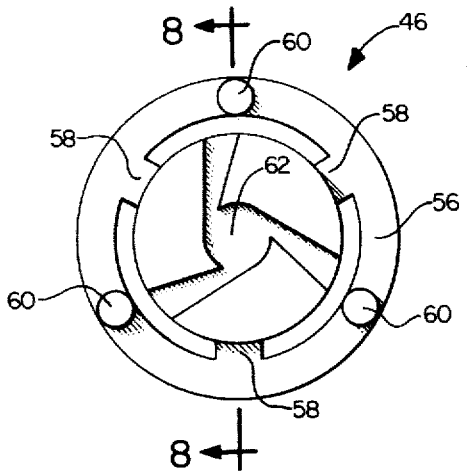
FIG. 7 is a front elevational view of a check valve utilized in the nozzle shown in FIG. 1.

Check valve 46 is also integrally formed and has a check valve tail 48 with a bore 50 therein. Check valve tail 48 is utilized to aid in slidably mounting check valve 46 in bore 22 and also to maintain the center alignment of check valve 46 as it moves to open and close bore 22. To close off bore 22 a liquid-tight bore seal is achieved by check valve 46 through the co-action of conical surface 54 and the end of barrel 20. It has been found that if an annular groove 28 is provided at the mouth of bore 22, a highly effective seal can be achieved with conical surface 54. Surrounding the distal end of conical surface 54 is an annular spring 56 which is connected to the remainder of check valve 46 by means of spring legs 58. This arrangement is shown in FIG. 7. The thickness of annular spring 56 should be such that it will flex upon application of the liquid pressure applied against check valve 46 upon actuation of the pump. Spring legs 58 dimensioned to provide substantially rigid attachment between annular spring 56 and check valve 46.

Figure 8:
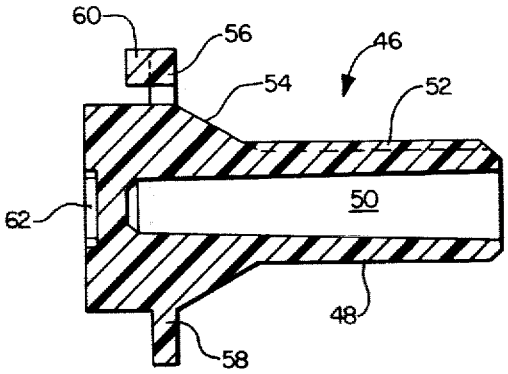
FIG. 8 is a sectional view taken through section line 8—8 in FIG. 7.
Figure 9:
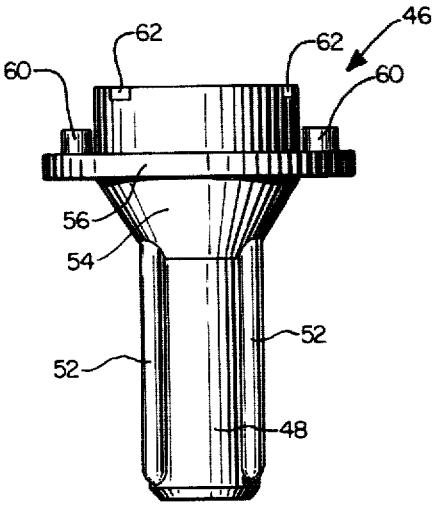
FIG. 9 is a top plan view of the check valve shown in FIG. 1.
Figure 10:
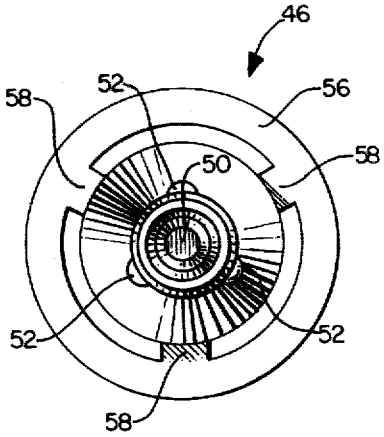
FIG. 10 is a rear elevational view of the check valve shown in FIG. 1.

Nibs 60 are provided on the outside face of annular spring 56 so that they will bear against stop flange 44 at all times. As shown in FIGS. 8 and 9, ribs 52 are provided on the outside surface of check valve tail 48 so that there will be sufficient passage room for the liquid as it flows through bore 22 to dispensing aperture 32 when check valve 46 is in the open position.

Check valve 46 preferably has a planar face with a swirl chamber 62 molded therein. When swirl chamber 62 is in abutment with the planar inside surface 34 of nozzle cap 30 the swirl chamber will force the liquid to travel a path which will give a spray pattern. While the specific swirl chamber configuration shown in the drawings is a highly preferred configuration, it is understood that other configurations known in the art can be utilized to achieve this same function.

Figure 2:
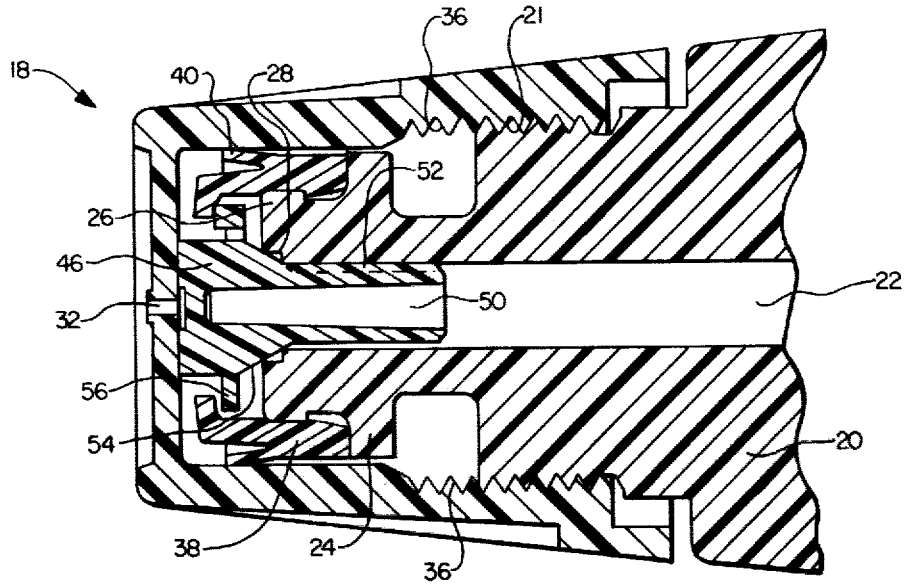
FIG. 2 is a sectional side elevational view of the nozzle shown in FIG. 1 with the nozzle in the closed position.
Figure 3:
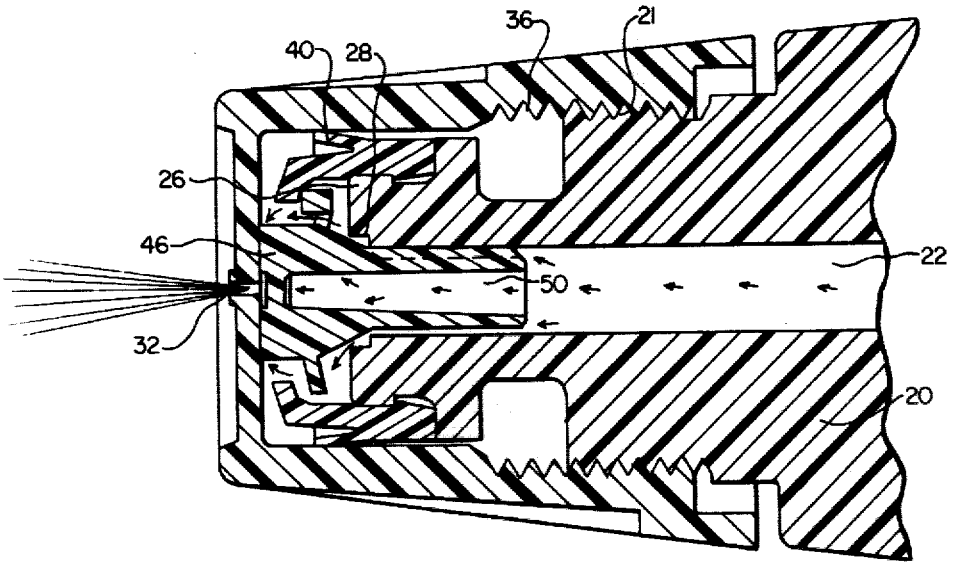
FIG. 3 is a sectional side elevational view of the nozzle shown in FIG. 1 with the nozzle in the spray position.
Figure 4:
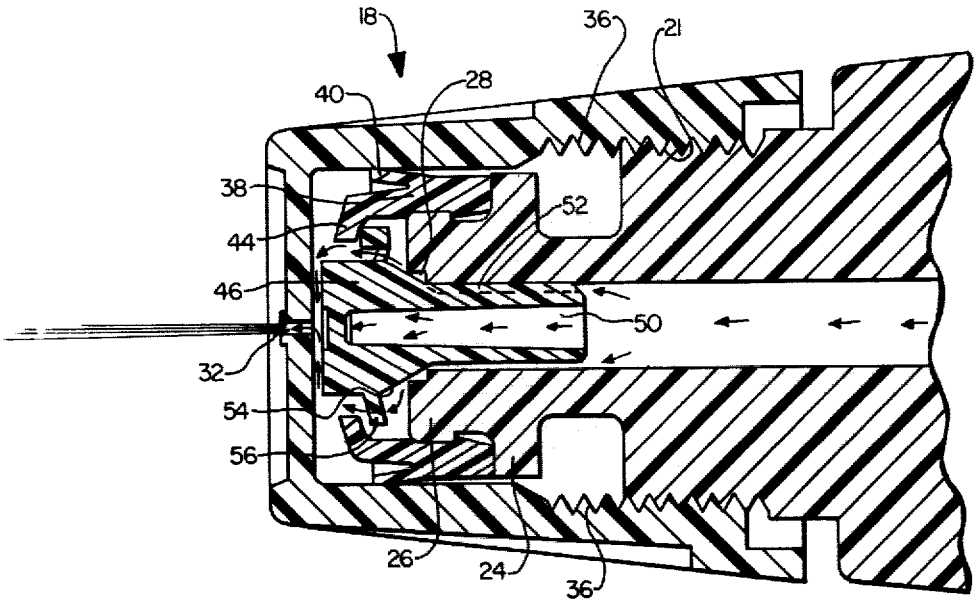
FIG. 4 is a sectional side elevational view of the nozzle shown in FIG. 1 showing the nozzle in the stream position.
Figure 5:
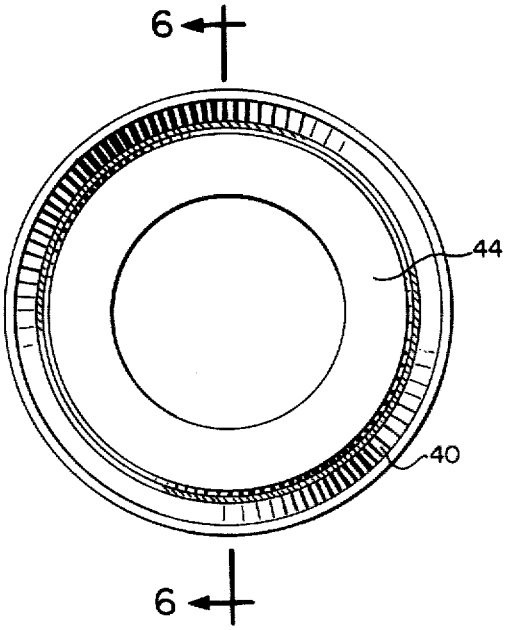
FIG. 5 is a rear view of the nozzle seal used in the nozzle shown in FIG. 1.
Figure 6:
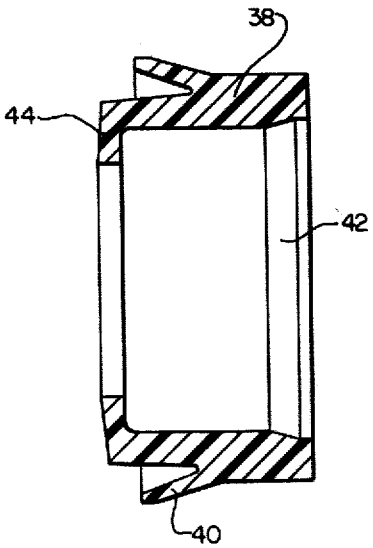
FIG. 6 is a sectional view taken through section line 6—6 in FIG. 5.

The particular nozzle shown in the drawings is one which is capable of effecting three modes of operation, a shut-off mode, a spray mode and a stream mode. In the shut-off mode passage of liquid through bore 22 is prevented even if the pump is actuated as check valve 46 is blocked from the movement which would open the liquid-tight bore seal. In the other two modes check valve 46 is free to move under the urging of liquid pressure in bore 22 upon pump actuation. The three modes are shown in FIGS. 2–4. In FIG. 2 the shut-off mode is shown. In this mode it is impossible to discharge liquid through bore 22 by actuation of the pump since nozzle cap 30 is tightened until it engages the planar face of check valve 46. The liquid-tight bore seal is therefore maintained.

To achieve the second mode of operation, i.e. the spray mode, nozzle cap 30 is loosened until it is displaced a distance away from check valve 46 so that check valve 46 is able to move and thus open the liquid-tight bore seal between conical seal 54 and annular groove 28. However, nozzle cap 30 will still be close enough to check valve 46 whereby the planar face of check valve 46 can abut inside planar face 34. The abutment is necessary to force the liquid to pass through swirl chamber 62 to effect the spray dispensing pattern. The position of check valve 46 and the flow of liquid is shown in FIG. 3. With nozzle cap 30 in the spray position the pump is actuated by pulling trigger 14. Liquid pressure builds in bore 22 until it is sufficient to overcome the spring bias provided by annular spring 56. Once the spring bias has been overcome, check valve 46 moves to open the liquid-tight bore seal and thus allows the pump liquid to be forced through swirl chamber 62 and out aperture 32. After a charge of liquid has been dispensed, pump trigger 14 is released. Upon the end of product discharge, check valve 46 returns to the seal position to provide a liquid-tight bore seal at the urging of annular spring 56. In some prior art pumps, e.g. U.S. Pat. No. 3,685,739, closing off of the bore after liquid has been dispensed relies upon the creation of a partial vacuum carried by the pump during its loading cycle. With these types of pumps there is a period of time before the bore can be closed off that air is sucked into the bore and into the pump chamber. This is disadvantageous as the sucked in air displaces liquid in the pump chamber and thus the subsequent charge of liquid will be of a reduced quantity. However, for the nozzle of this invention, the return of check valve 46 to the seal position is effected by spring action means which is acting against liquid in bore 22. Thus there is a very little, if any at all, amount of air being sucked into the bore. By keeping air out of the bore a full charge of liquid is assured in the pump chamber.

To achieve the third mode of operation, nozzle cap 30 is screwed further away from check valve 46 so that the travel of check valve 46 is unable to achieve abutment between the planar face of check valve 46 and the planar inside surface 34 of nozzle cap 30. Since there is no abutment the liquid is allowed to pass to dispensing aperture 32 without passing through the swirl chamber and thus a stream of liquid is dispensed instead of a spray. In this mode check valve 46 will return to achieve a liquid-tight bore seal as described for the first modes.

Not only can the nozzle of this invention have a three mode configuration, it is also possible to have a single mode configuration with or without nozzle shut-off. For example, nozzle cap 30 can be mounted to barrel 20 by utilization of a bead and groove snap-on arrangement. With this configuration no shut-off will be available and the distance at which inside planar surface 34 is displaced from check valve 46 is fixed. This distance can be fixed so that check valve 46 cannot obtain abutment with the end wall of nozzle cap 30 or so that this abutment can be achieved. If abutment is not achieved there will be a stream dispensing mode or, on the other hand, if abutment is achieved there will be a spray dispensing mode. If it is desired to have a nozzle with a shut-off and spray mode, a configuration similar to the one shown in the drawings can be used with a modification to the cap and barrel threads so that the nozzle cap will be restricted to the extent it can move from the check valve. On the other hand, if a shut-off and stream mode only is desired, then the configuration shown in the drawings may be used with the modification designing the face of the check valve so that the liquid can go directly to the aperture.

What is claimed is:

1. A nozzle for fitment to hand actuated liquid pumps having a barrel portion with a bore therethrough for passage of liquid, said nozzle comprising:

a. an integrally formed nozzle cap which includes:
   i. an end wall having an aperture through which liquid from said bore is dispensed, and
   ii. a skirt portion having mounting means for mounting said nozzle cap around the end portion of said barrel;

b. an integrally formed nozzle seal means attached to said barrel and enclosed by said nozzle cap, said nozzle seal means providing a peripheral liquid-tight seal around said barrel between said nozzle cap and said barrel, and said nozzle seal means having stop means displaced outwardly from the end of said barrel; and c. an integrally formed check valve means movably positioned at the mouth of said bore, said check valve means having, i. a seal portion which selectively forms a liquid-tight bore seal with said end portion of said barrel to close off the flow of liquid through said bore, and ii. a spring portion in operative relationship with said stop means whereby said spring portion biases said seal portion to form its said liquid-tight bore seal, but said spring portion having a biasing strength sufficiently low to allow liquid pressure in said bore, developed by actuation of said pump, to move said check valve away from said barrel end portion so that said liquid-tight bore seal is opened and liquid in said bore can pass to said aperture in nozzle cap.

2. The nozzle of claim 1 wherein said nozzle is made of thermoplastic material.

3. The nozzle of claim 2 wherein said nozzle is made of polyethylene or polypropylene.

4. The nozzle of claim 1 wherein said end wall has a planar inside surface at said aperture and wherein said check valve means has a planar face which is abutable with said planar inside surface at said aperture.

5. The nozzle of claim 1 wherein said seal portion is a conical surface which abuts the mouth of said bore to form said liquid-tight bore seal and has its center axis congruent with the center axis of said bore.

6. The nozzle of claim 5 wherein said spring portion is an annular ring connected to the remainder of said check valve means at a point adjacent said conical surface by a plurality of radially extending legs.

7. The nozzle of claim 6 wherein said end wall has a planar inside surface at said aperture and wherein said check valve means has a planar face which is abutable with said planar inside surface at said aperture.

8. The nozzle of claim 4 wherein said seal portion is a conical surface which abuts the mouth of said bore to form said liquid-tight bore seal and has its center axis congruent with the center axis of said bore.

9. The nozzle of claim 5 wherein there is an annular groove at the mouth of said bore which coacts with said conical surface to form said liquid-tight bore seal.

10. The nozzle of claim 6 wherein said stop means is an annular flange dimensioned to contact said annular ring without interferring with the movement of said check valve means.

11. The nozzle of claim 4 wherein said nozzle is made of polyethylene or polypropylene.

12. The nozzle of claim 5 wherein said nozzle is made of polyethylene or polypropylene.

13. The nozzle of claim 7 wherein said nozzle is made of polyethylene or polypropylene.

14. The nozzle of claim 10 wherein said nozzle is made of polyethylene or polypropylene.

15. The nozzle of claim 4 wherein said planar face has liquid passage channels for providing a spray pattern for said dispensed liquid when said planar face is abutted with said planar inside surface.

16. The nozzle of claim 15 wherein said nozzle has a shut-off mode, a first dispensing mode and a second dispensing mode and wherein, i. said shut-off mode is effected by moving said nozzle cap so that said planar inside surface presses against said planar face to prevent movement of said check valve, ii. said first dispensing mode is effected by moving said nozzle cap so that said planar inside surface is a distance displaced from said planar face so that said check valve can move to open said liquid-tight bore seal and said planar face of said check valve is able to obtain abutment with said planar inside surface upon said movement of said check valve, and iii. said second dispensing mode is effected by moving said nozzle cap whereby said planar inside surface is displaced from said planar face a distance further than the distance in (ii) so that said planar face cannot abut said planar inside surface.

17. The nozzle of claim 16 wherein said mounting means is a helical thread for cooperation with a helical thread carried by said barrel.

18. The nozzle of claim 16 wherein said nozzle is made of thermoplastic material.

19. The nozzle of claim 16 wherein said nozzle is made of polyethylene or polypropylene.

20. The nozzle of claim 16 wherein said seal portion is a conical surface which abuts the mouth of said bore to form said liquid-tight bore seal and has its center axis congruent with the center axis of said bore.

21. The nozzle of claim 20 wherein said spring portion is an annular ring connected to the remainder of said check valve means by way of a plurality of radially extending legs.

22. The nozzle of claim 20 wherein there is an annular groove at the mouth of said bore which coacts with said conical surface to form said liquid-tight bore seal.

23. The nozzle of claim 21 wherein said stop means is an annular flange dimensioned to contact said annular ring without interferring with the movement of said check valve means.

24. The nozzle of claim 23 wherein said nozzle is made of polyethylene or polypropylene.

* * * * *